United States Patent [19]

Koike et al.

[11] Patent Number: 4,799,084

[45] Date of Patent: Jan. 17, 1989

[54] IMAGE FORMING APPARATUS

[75] Inventors: Michiro Koike, Kawasaki; Takashi Ozawa, Ichikawa; Yasuyoshi Yamamoto, Tokyo; Masashi Ohashi, Tokyo; Akiyoshi Kimura, Tokyo; Nobukazu Sasaki, Tokyo; Toshirou Kasamura, Yokohama; Atsushi Kubota, Machida; Tatsuya Shiratori, Yokohama; Toshihiko Kusumoto, Tokyo, all of Japan

[73] Assignee: Canon Kabushiki Kaisha, Tokyo, Japan

[21] Appl. No.: 848,388

[22] Filed: Apr. 4, 1986

[30] Foreign Application Priority Data

Apr. 9, 1985 [JP] Japan ..... 60-74967
Apr. 10, 1985 [JP] Japan ..... 60-77314

[51] Int. Cl.[4] ..... G03G 15/00

[52] U.S. Cl. ..... 355/14 SH; 355/3 SH; 271/250

[58] Field of Search ..... 355/3 SH, 14 SH; 271/249, 250, 251, 227, 228

[56] References Cited

U.S. PATENT DOCUMENTS

| | | | |
|---|---|---|---|
| 4,187,024 | 2/1980 | Satomi et al. | 355/14 R |
| 4,260,242 | 4/1981 | Nishikawa | 355/14 TR |
| 4,281,244 | 7/1981 | Murata et al. | 250/225 |
| 4,334,759 | 9/1982 | Clausing | 355/3 SH |
| 4,334,759 | 6/1982 | Clausing | 355/3 SH |
| 4,350,439 | 9/1982 | Tanioka et al. | 271/227 X |
| 4,519,700 | 5/1985 | Barker et al. | 355/3 SH |
| 4,523,832 | 6/1985 | Strutt et al. | 355/3 SH |
| 4,548,401 | 10/1985 | Nishikawa | 271/227 X |
| 4,585,336 | 4/1987 | Tanaka | 355/3 SH |
| 4,657,239 | 4/1987 | Ikesue et al. | 271/227 |

FOREIGN PATENT DOCUMENTS

| | | |
|---|---|---|
| 2810294 | 9/1978 | Fed. Rep. of Germany . |
| 2922977 | 12/1979 | Fed. Rep. of Germany . |
| 2924489 | 3/1980 | Fed. Rep. of Germany . |
| 59-177237 | 10/1984 | Japan . |
| 60-14250 | 1/1985 | Japan . |
| 2141695 | 1/1985 | United Kingdom . |

*Primary Examiner*—A. C. Prescott
*Assistant Examiner*—Jane Lau
*Attorney, Agent, or Firm*—Fitzpatrick, Cella, Harper & Scinto

[57] ABSTRACT

An image forming apparatus includes an image forming station for conveying a sheet material along a lateral reference position and for forming an image on the sheet material; refeeding device for refeeding to the image forming station the sheet material on which the image has been formed in the image forming station; means, provided in the sheet refeeding means, for shifting the sheet material in the lateral direction from the lateral reference position by a predetermined amount, wherein the amount of the shift is predetermined on the basis of a change in a lateral dimension of the sheet material resulting from an image forming operation in the image station.

32 Claims, 12 Drawing Sheets

IMAGE FORMING APPARATUS

FIELD OF THE INVENTION AND RELATED ART

The present invention relates to an image forming apparatus such as a copying machine and a laser beam printer which forms an image on a sheet, more particularly to an image forming apparatus which can form plural images superimposedly on one side of the same transfer sheet or which can form a duplex image, that is, images are formed on both sides of a transfer material.

An image forming apparatus such as a copying machine has been proposed by the assignee of the present application, as shown in FIG. 1. The image forming apparatus 1 which will hereinafter be called also "copying apparatus", comprises a main assembly 3 containing therein a copying station 2 (an image forming station). The main assembly 3 includes an original supporting table 5, a light source, a lens system 7, two cassettes 9*a* and 9*b*. Substantially at the center of the main assembly 3, there, is provided the copying station 2 comprising a cylindrical photosensitive member 10 and other means. Around the photosensitive member 10, there are provided two developing device 11*a* and 11*b* containing different color developers, a cleaning device 12, a primary charger 13, a transfer charger 15 disposed adjacent to a leading edge of a conveying device 17 and a separation charger 16. Adjacent the cassettes 9*a* and 9*b*, there are pick-up rollers 19*a* and 19*b*. By those pickup rollers 19*a* and 19*b*, a conveying roller couple 20*a* and 20*b*. The transfer sheet S is guided and transported to a couple of registration roller couple 22 along passages 21*a* and 21*b*. The transfer sheet S which is to be subjected to the superimposing copy operation or duplex copy operation is conveyed to the registration roller couple 22 along the sheet passage disposed at a lower part of the main assembly 3. Adjacent the downstream end portions of the conveying device 17, there is an image fixing station 25. Downstream of the image fixing station 25 with respect to advancement of the transfer sheet S, there is a first couple of discharging rollers 26 and a second couple of discharging rollers 27, which serve to normally discharge the transfer sheet S onto a tray or the like outside the main assembly. Between the first discharging roller couple 26 and the second discharging roller couple 27, there are provided a flapper 29 and an auxiliary flapper 30. Normally, the transfer sheet S discharged through the discharging roller couple 26 is conveyed along the upper surface of the flapper 29 taking the position indicated by solid lines, and swings the auxiliary flapper 30 in the direction of an arrow A by its advancing force. In response thereto, a photosensor 32 is actuated by a detecting arm 31, so that the passage of the transfer sheet S is detected, and the sheet S is discharged by the second discharging roller couple 27 rotating in its forward direction. When the duplex copying operation is to be performed, the transfer sheet S is conveyed part of the way in the same manner as in the normal mode. More particularly, the forward rotation of the second discharging roller couple 27 partly projects the transfer sheet S outside the main assembly. However, at the point of time when the trailing edge of the transfer sheet S is away from the auxiliary flapper 30, the second discharging roller couple 27 is rotated backwardly by the operation of the detecting arm 31 and the photosensor 32. The transfer sheet S is thereby guided by the lefthand sides of the flapper 29 and the auxiliary flapper 30 to be introduced into the passage 33. Therefore, upon the duplex copy operation, the transfer sheet is fed again by the second discharging roller couple 27, the flapper 29 and the auxiliary flapper 30, the detecting arm 31, the photosensor 32 and the passage 33. Upon the superimposing mode operation, the flapper 29 is switched to take the broken line position, so that the transfer sheet S, discharged through the first discharging roller couple 26, is introduced into the passage 33 by the guiding function of the righthand side of the flapper 29. Therefore, upon the superimposing copy mode, the transfer sheet is fed again to the image forming station by the first discharging roller couple 26, the flapper 29 and the passage 33. The transfer sheet introduced into the passage 33 is guided to the registration roller couple 22 through the conveying roller couple 35 and 36 and the sheet conveying device 23 comprising a lateral registration means effective to align one lateral edge of the transfer sheet with a lateral reference line.

As described, in the conventional copying apparatus, when superimposed images or duplex images are to be formed on one and the same transfer sheet S, the transfer sheet having been subjected to image forming operation in the image forming station 2 and the image fixing station 25, is fed into the image forming station 2 by a sheet refeeding means such as the flapper and the sheet conveying device 23. In doing this, the alignments of the transfer sheet S in the lateral direction and the longitudinal direction are performed by the lateral registration means 37 and the registration roller couple 22, which serve to align one lateral end of the transfer sheet and the leading edge of the transfer sheet with the respective reference positions. The alignment of the leading edge is accomplished by feeding the sheet material in timed relation with the position of the image on the photosensitive member 10, so as to align the leading edge of the latent image on the photosensitive member 10 with the leading edge of the image formation area on the sheet material In the copying station 2 of the copying apparatus 1, the transfer sheet is subjected to an image fixing operation after the toner image is transferred thereto. By the transferring operation, the transfer sheet is elongated when the fixing station 2 is of a pressure fixing type, or contracted when the image fixing station 25 is of heat fixing type. That is, the transfer sheet is changed in its dimension in the conveying direction and the lateral direction depending on the type of the image fixing system. This is a problem when the copying apparatus 1 performs the superimposing copy operation or duplex copy operation, since one lateral side and the leading edge of the transfer sheet are aligned with the respective predetermined reference positions. Because of the dimensional change of the transfer sheet, there occurs an increased deviation of the superimposed image with the distance from the reference positions in the case of the superimposed copy, and the image can be partly missed in the case of the duplex copy.

FIG. 14 explains the deviation, wherein the letter "A" and the letter "B" are superposed on one side of the same transfer material by the superimposing copy. It is understood that since the conveying reference E is the same for the first copy of "A" and for the second copy of "B", the letter "B" is deviated rightwardly by the amount corresponding to the amount of the lateral contraction of the transfer sheet.

SUMMARY OF THE INVENTION

Accordingly, it is a principal object of the present invention to provide an image forming apparatus wherein the image is not missed or deviated, thus providing a good quality image.

It is another object of the present invention to provide an image forming apparatus wherein a good image can be provided irrespective of the contraction or elongation of the sheet material.

It is another object of the present invention to provide an image forming apparatus which can provide a good image on a transfer material, irrespective of elongation and contraction of the sheet material in the sheet conveying direction.

It is a further object of the present invention to provide an image forming apparatus which can provide a good image on a sheet material, irrespective of elongation and contraction of the sheet material in the lateral direction.

According to an embodiment of the present invention, the sheet material is shifted from the reference conveying position in the sheet refeeding station in consideration of the lateral elongation or contraction produced in the image forming station. Therefore, in the superimposing copy operation, the lateral deviation between the first image and the second image can be effectively prevented to such an extent that the deviation is not easily conspicuous by naked eyes. Also, in the duplex copy operation, there is hardly any missing image in the image on the back or second side of the transfer material. Thus, a good quality image can be easily and inexpensively formed on the transfer sheet.

According to another embodiment of the image forming apparatus, the refeeding timing by registration means in the refeeding operation is advanced or delayed with respect to the predetermined synchronous registration timing, in consideration of the elongation or contraction of the sheet material in the conveying direction. Therefore, the deviation of the image in the conveying direction and the occurrence of the missing image in the conveying direction can be effectively prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
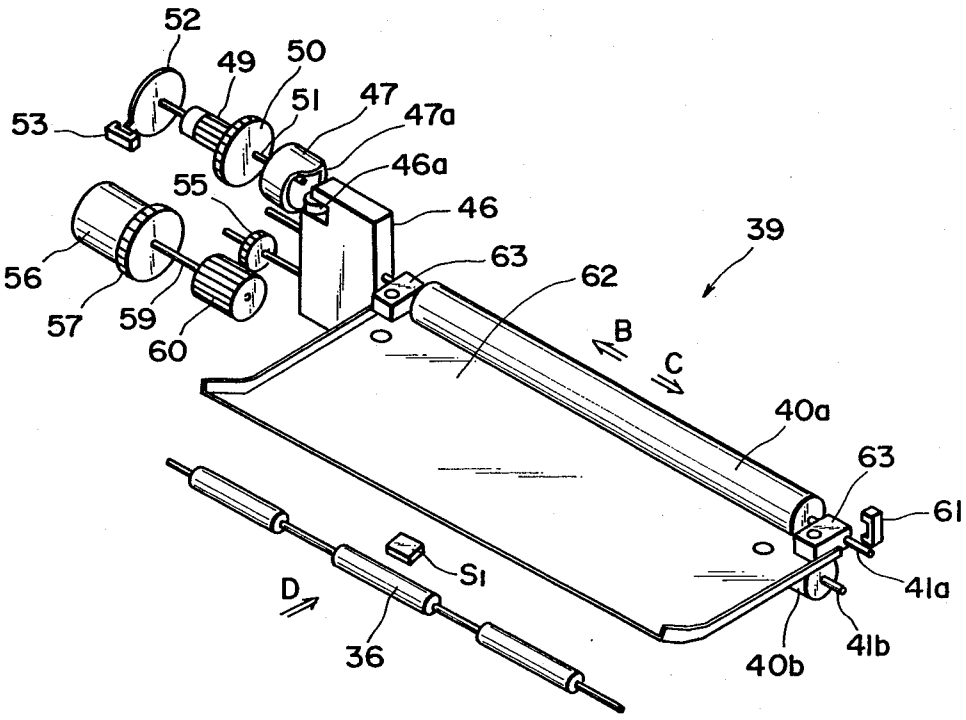
FIG. 2 is a perspective view of a transfer sheet reference position correcting means usable with an image forming apparatus according to an embodiment of the present invention.
Figure 3:
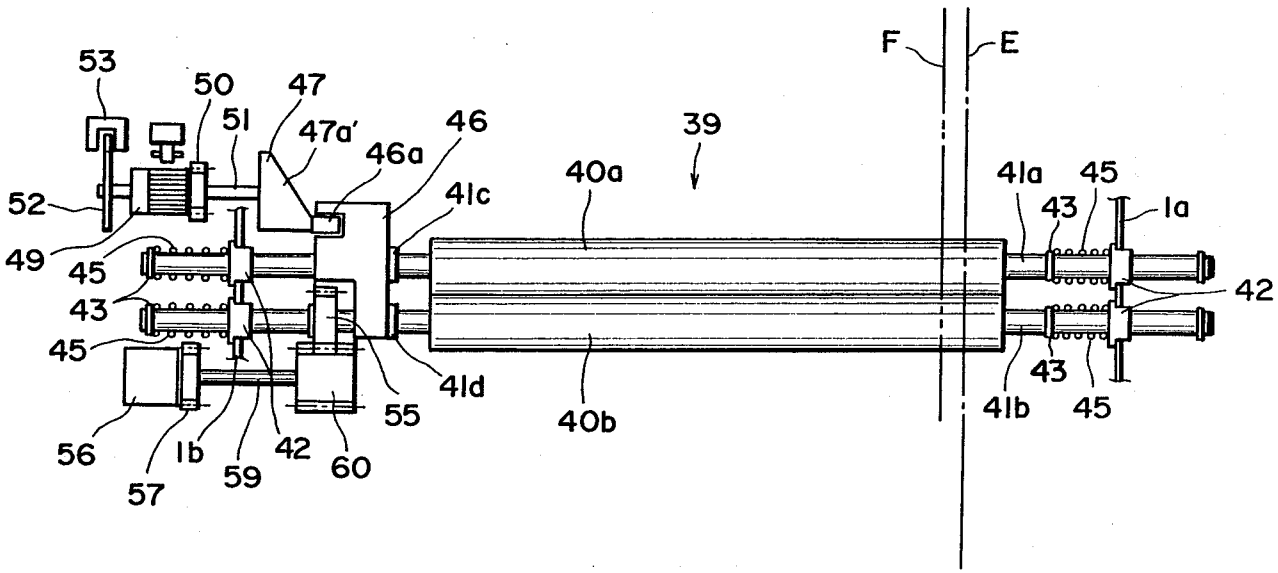
FIG. 3 is a front view of the correcting means shown in FIG. 3.

Referring to FIGS. 2 and 3, there is shown transfer sheet reference position correcting means 39. FIGS. 2 and 3 are a perspective view and a front view thereof, respectively. The correcting means is provided in the sheet conveying passage 23 in place of the lateral registration means 37. The correcting means 37 functions to correct the position of the transfer sheet in the direction perpendicular to its conveying direction, that is, the lateral direction and comprises an upper roller 40*a* and a lower roller 40*b* which are press-contacted. The upper roller 40*a* is supported on a shaft 41*a* only for rotation. The lower roller 40*b* is securely fixed to a shaft 41*b*. The shaft 41*a* of the upper roller 40*a* and the shaft 41*b* of the lower roller 40*b* are rotatably and slidably supported on front and rear plates 1*a* and 1*b* of the copying apparatus 1 through bearings 42. Those shafts 41*a* and 41*b* are normally biased in the leftward direction as seen in FIG. 3 by a compression spring 45 disposed between the bearings 42 and collars provided on the shafts 41*a* and 41*b*. The shafts 41*a* and 41*b* are inserted into a block 46 only for rotation. The block 46 is engaged to a cam member 47 through a roller 46*a* mounted on the block 46. The cam member 47 is in the form of a cylinder and has an inclined cam surface 47*a* at one end thereof. A spring clutch 49 is operatively coupled with a shaft 51 of the cam member 47 and a driving gear 50. The spring clutch 49 is driven by an unshown solenoid, and the driving force is transmitted from the driving gear 50 to the shaft 51 through the clutch 49 so as to rotate the cam member 47. By one rotation of the cam member 47, the upper roller 40*a* and the lower roller 40*b* are rightwardly and leftwardly (B, C in FIG. 2) shifted against the force of the springs 45 through the block 46. Collars 41*c* and 41*d* are securedly mounted to the shafts 41*a* and 41*b* and are effective to transmit the movement of the block 46 to the shafts 41*a* and 41*b*. Because of the position limiting function of a photosensor 53 and the light blocking plate 52 provided adjacent an end of the shaft 51, the central portion 47*a*' of the inclined cam surface 47*a* is normally engaged to the roller member 46*a*, so that the upper roller 40*a* and the lower roller 40*b* are disposed at the central position, that is, the home position which is the middle of the shifting stroke. To the shaft 41*b* of the lower roller 40*b*, a gear 55 is fixed. When an electromagnetic clutch 56 is actuated, the driving force is transmitted from a driving gear 57 to a shaft 59 through the clutch 56, whereby a transmission gear 60 is rotated. By this rotation, the gear 55 meshed with the gear 60 rotates, thereby rotating the lower roller 40b, whereby the transfer sheet which has been stopped by its leading edge contacting the nip formed between the upper roller 40a and the lower roller 40b, is advanced.

As shown in FIG. 2, adjacent to the nip between the upper roller 40a and the lower roller 40b, a light sensor 61 is disposed which serves to detect one lateral end of the transfer sheet. Designated by a reference numeral 62 in FIG. 2, is a top guide plate for guiding the transfer sheet to the nip between the upper roller 40a and the lower roller 40b, and is securedly fixed to the shaft 41a by mounting blocks 63. Designated by a reference numeral 36 is a lower roller of the conveying roller couple described in conjunction with FIG. 1.

Figure 1:
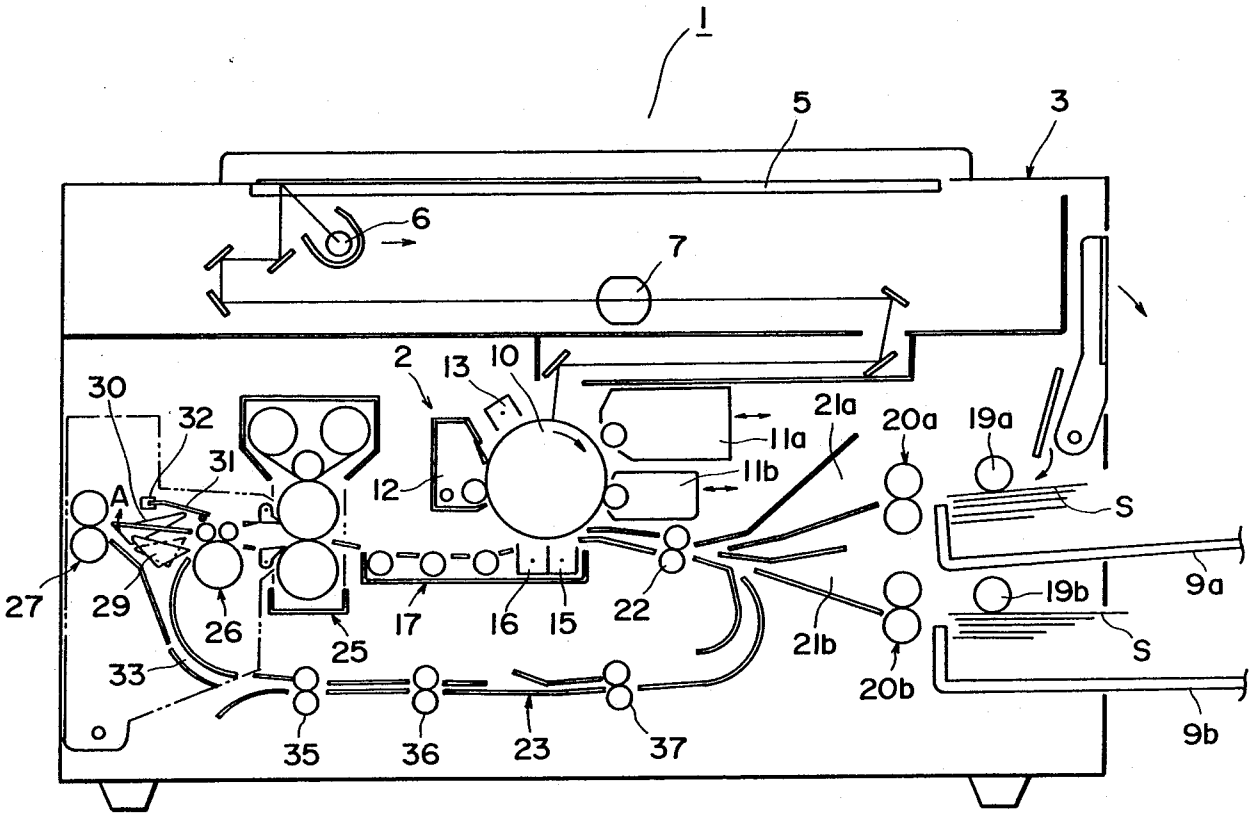
FIG. 1 is a sectional view of an image forming apparatus to which the present invention can be used.

In operation, the transfer sheet receives an image at the copying station 2 and transported through the fixing station 25. The transfer sheet is re-fed for the purpose of the superimposing copy or the duplex copy. As shown in FIG. 1 by an arrow D, the transfer sheet is introduced into the transfer sheet reference position correcting means 39 in the sheet conveying passage 23. A sensor S1 detects the passage of the transfer sheet immediately before the correcting means 39. In response thereto, the transporting function by the conveying roller couple 36 continues for a predetermined period of time after the leading edge of the transfer sheet engages the nip formed by the then resting upper roller 40a and the lower roller 40b. When the predetermined period of time passes, the conveying roller couple 36 stops. By this, a proper amount of slack or loop of the transfer sheet is formed with its leading edge engaging the nip between the upper roller 40a and the lower roller 40b. Then, the conveying roller couple 46 restarts, and simultaneously, the electromagnetic clutch 56 is actuated to permit the rotation of the driving gear 57 to be transmitted to the gear 55 through the shaft 59 and the gear 60, so that the lower roller 40b rotates. So, the transfer sheet starts to advance by and between the upper roller 40a and the lower roller 40b with said loop being kept. Simultaneously, the spring clutch 49 is engaged to permit the rotation of the driving gear 50 to be transmitted to the cam member 47 through the shaft 51 so that the cam member 47 rotates. By this rotation, the block 46 moves in the direction indicated by C through the roller 46a from its home position. If necessary as in the case where the edge of the transfer sheet is at the right side of the sensor 61, it once moves to the rightmost position, and then is moved to the leftmost position in the direction indicated by the arrow B, and subsequently moved in the direction indicated by an arrow C. By this, the transfer sheet is shifted laterally, that is, perpendicularly to the direction of its advancement, while being advanced. During this, the existence of the loop is effective to prevent the transfer sheet from being deformed and to allow the transfer sheet to be smoothly shifted. Here, the photosensor 61 is disposed at a predetermined position which is shifted from the sheet conveying reference position E in the first copying process by the amount corresponding to the change of the size of the transfer sheet in the lateral direction produced in the image fixing operation by the fixing station 25. More particularly, when the change is a contraction, the position is shifted to an inside position F by an amount of one half of the contraction. The photosensor 61 is movable in the lateral direction and can be finely controlled depending on the size of the transfer sheet to be used. The control is effected by detecting the size of the transfer sheet provided from the cassette, using a servo motor or the like. Because of this, the variation in the amount of contraction or elongation depending on the size or the material of the sheet can be compensated. When the transfer sheet S is shifted in the lateral direction while being transported in the manner described above, the completion of the position correction is detected by the light edge of the transfer sheet blocking the light to the photosensor 61. In response to the detection, the spring clutch 49 is disengaged so that the lateral shifting of the upper roller 40a and the lower roller 40b stops. The upper roller 40a and the lower roller 40b continue rotating for a predetermined period of time so that the transfer sheet is advanced from the sheet conveying passage 23 to the registration roller couple 22 with its lateral position corrected. After the transfer sheet is conveyed, the electromagnetic clutch 56 is disengaged so as to stop rotations of the rollers 40a and 40b. After termination of the conveyance, the spring clutch 49 is engaged so as to rotate the cam member 47, thus moving the upper roller 40a and the lower roller 40b back in the direction B. This movement of the position correcting means 39 stops when the light blocking plate 52 and the photosensor 53 detect that it comes to the central home position. Thus, it is prepared for the next position correcting operation.

In the embodiment described above, the sensor 61 is disposed deviated from the sheet reference position E. However, the sensor 61 may be disposed at the sheet reference position E. In this case, the sheet is once aligned with the sheet reference position, and thereafter, the sheet is shifted in the lateral direction by a proper amount. The shifting means is controlled to effect this.

In this embodiment, one lateral side of the transfer sheet is aligned. However, it is a possible alternative that the central line of the transfer sheet is aligned with a corresponding reference position so that the control of the position is effected based on the center line of the transfer sheet.

The description will be made with respect to the correction for the dimensional change of the transfer sheet in the direction of its advancement, the dimensional change being produced in the image fixing step.

In this case, the registration roller couple 22 may be used as the means for correcting the reference position. However, it is possible that an additional means is used for correcting the position, independently from the registration roller couple 22. When the registration roller couple 22 is used also for correcting the transfer sheet position, the control is effected by shifting by a proper amount the timing of the start of the rotation thereof, that is, the start of the refeeding is delayed or advanced from the reference timing which is used in the first copying process wherein the transfer sheet is supplied from the cassette 9a to the photosensitive member 10, for example. More particularly, when the dimensional change is the contraction, the time of the start is delayed by the amount of one half of the time required for the amount of contraction to be fed. Therefore, the transfer sheet having been processed in the copying station 2 and the fixing station 25 is re-fed for the purpose of the superimposing copy and the duplex copy and introduced to the registration roller couple 22 (the position correcting means in this case) through the sheet conveying passage 23. Then, a sensor S2 detects that the transfer sheet engages the registration roller couple 22, and its rotation starting timing is shifted.

Figure 5:
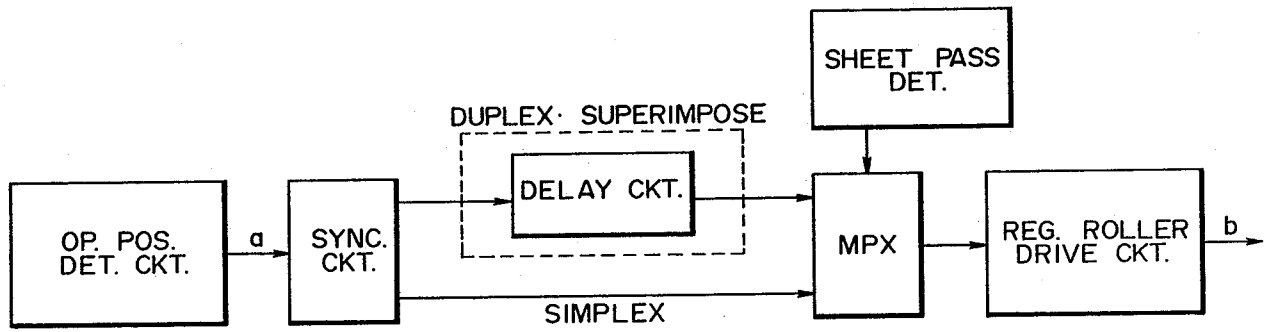
FIG. 5 is a block diagram illustrating control of the apparatus.
Figure 6:
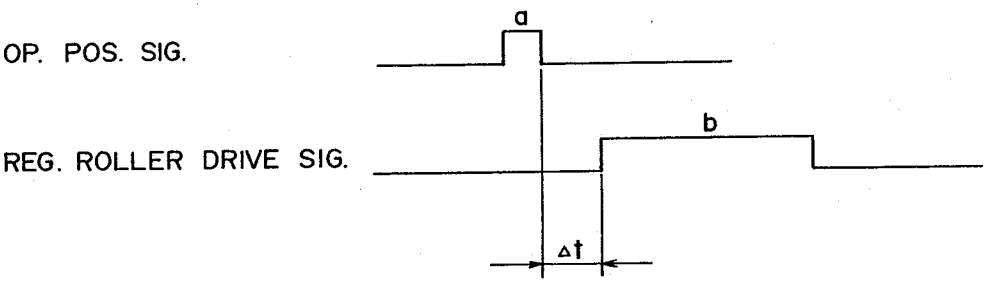
FIG. 6 is a time chart illustrating the control.

FIG. 5 is a block diagram illustrating the control of the above embodiment, and FIG. 6 is a time chart. In FIG. 5, the sheet passage detecting circuit includes a sensor S2. The reference characters MPX is a multiplexer. In FIG. 6, the time period Δt is T1, while the time period Δt in the duplex or superimposing copy is (T1+T2), where the time T2 is a delay time provided by the delaying circuit.

Figure 7:
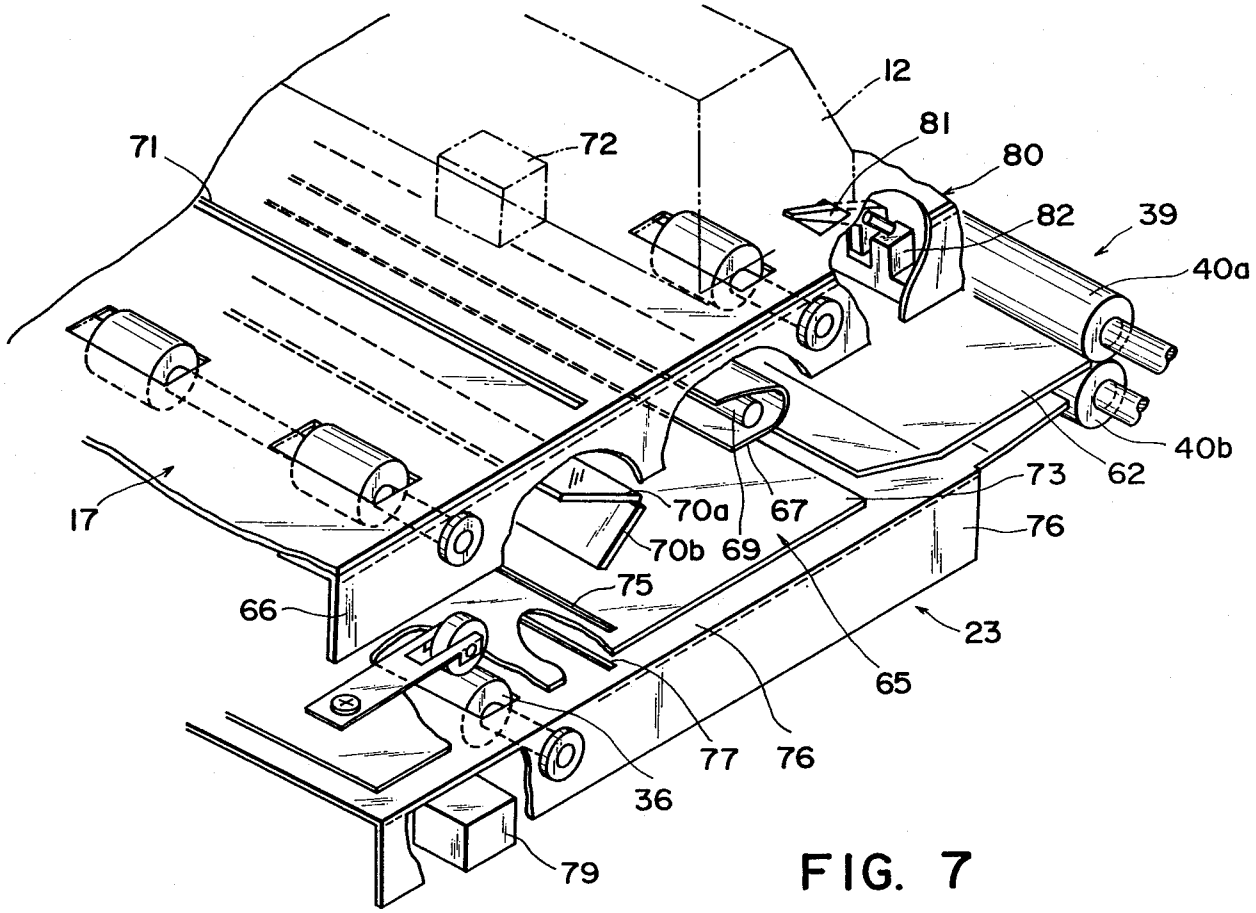
FIG. 7 is a perspective view of a transfer sheet reference position correcting means usable with an image forming apparatus according to another embodiment of the present invention.

Referring to FIG. 7, another embodiment of the present invention will be described.

In this embodiment, there is provided detecting means 65 for detecting the change in the lateral dimension of the sheet, that is, the dimension measured in the direction perpendicular to the conveyance of the sheet. The detecting means 65 is constructed in association with the conveying device 17 disposed before the image fixing station 25 and the sheet conveying passage 23 disposed before the position correcting means 39 described with FIGS. 2 and 3. A shade 67 is fixed on a frame 66 of the conveying device 17, and in the shade 67, there is provided a light source 69 such as a halogen lamp. The light produced by the light source 69 is reflected by reflecting mirrors 70*a* and 70*b* supported on the frame 66. The light reflecting from the mirror 70*a* is directed through a slit 71 of the frame 66 having a sufficient width and extending in the direction perpendicular to the conveyance of the transfer sheet, to a light receiving unit 72 mounted to the bottom of the cleaning device 17 and comprising a light receiving element such as CdS and a lens system. The light reflected by the mirror 70*b* is directed through a slit 75 formed similarly in the top guide plate 73 of the sheet conveying passage 23 and through a slit 77 formed in the bottom guide plate 76 of the sheet conveying passage 23, to a light receiving unit 79 mounted in the bottom surface of the bottom guide plate 76.

In FIG. 7, there is further shown a detecting means 80 for detecting the dimension of the transfer sheet in the direction of conveyance before it is subjected to the image fixing operation. The detecting means is rotatably supported on the frame 66 of the conveying device 17. It comprises a detecting lever 81 for detecting the passage of the transfer sheet and a photosensor 82 which is fixed on the frame 66 and which is shaded in response to rotation of the lever 81. When the transfer sheet is conveyed from the copying station 2, the detecting lever 81 which is normally inserted across the passage of the transfer sheet in the conveying device 17, is pivotted by the passage of the transfer sheet, so that the photosensor 82 is shaded for a predetermined period of time, which corresponds to the length, that is, the dimension of the transfer sheet in the direction of its conveyance. Therefore, the length can be detected.

In operation, when the copying operation starts by depressing a copy button, the light source 69 is turned on, and the light produced thereby is received by the light receiving units 72 and 79 by way of the reflecting mirrors 70*a* and 70*b* and the slits 71, 75 and 77. When the transfer sheet having received the toner image in the copying station 2 passes by the slit 71, the amount of the light received by the light receiving unit 72 is reduced by the partial blocking of the light from the light source 69 by the transfer sheet, and the reduction is detected by the light receiving unit 72. The electric signal corresponding to the amount of reduction detected is transmitted from the light receiving unit 72 to a microprocessor unit, which will hereinafter be called "MPU", for controlling the entire copying apparatus 1, and is stored in a memory of the MPU. Then, the transfer sheet which has passed by the slit 71 is subjected to the fixing operation in the fixing station 25, and then re-fed to the sheet conveying passage 24 by the sheet refeeding means comprising the flapper 29 or the like, for the purpose of the superimposing or duplex copying. When the transfer sheet re-fed to the sheet conveying passage 23 passes by the slit 77, the amount of the light received by the light receiving unit 79 is reduced, and the electric signal corresponding to the amount of reduction is transmitted from the light receiving unit 79 to the MPU. In the MPU, it is compared with the previous data obtained before the image fixing operation so that the change of the dimension of the transfer sheet in the lateral direction by the image fixing operation is determined. Then, MPU prepares itself for operating the position correcting means 39 in accordance with the amount of change detected in the manner described above. As shown in FIG. 2 by an arrow D, the transfer sheet is introduced into the transfer sheet reference position correcting means 39 in the sheet conveying passage 23. A sensor S1 detects the passage of the transfer sheet immediately before the correcting means 39. In response thereto, the transporting function by the conveying roller couple 36 continues for a predetermined period of time after the leading edge of the transfer sheet engages the nip formed by the then resting upper roller 40*a* and the lower roller 40*b*. When the predetermined period of time passes, the conveying roller couple 36 stops. By this, a proper amount of slack or loop of the transfer sheet is formed with its leading edge engaging to the nip between the upper roller 40*a* and the lower roller 40*b*. Then, the conveying roller couple 46 restarts, and simultaneously, the electromagnetic clutch 56 is actuated to permit the rotation of the driving gear 57 to be transmitted to the gear 55 through the shaft 59 and the gear 60, so that the lower roller 40*b* rotates. So, the transfer sheet starts to advance by and between the upper roller 40*a* and the lower roller 40*b* with said loop being kept. Simultaneously, the spring clutch 49 is engaged to permit the rotation of the driving gear 50 to be transmitted to the cam member 47 through the shaft 51 so that the cam member 47 rotates. By this rotation, the block 46 moves in the direction indicated by C through the roller 46*a* from its home position. If necessary as in the case where the edge of the transfer sheet is at the right side of the sensor 61, it once moves to the rightmost position, and then is moved to the leftmost position in the direction indicated by the arrow B, and subsequently moved in the direction indicated by an arrow C. By this, the transfer sheet is shifted laterally, that is, perpendicularly to the direction of its advancement, while being advanced. During this, the existence of the loop is effective to prevent the transfer sheet from being deformed and to allow the transfer sheet to be smoothly shifted. First, by the light sensor 61 being shaded by the right edge of the transfer sheet, the transfer sheet is set at a reference position F which is the reference position before the transfer sheet is subjected to the fixing operation. Then, the upper roller 40*a* and the lower roller 40*b* are shifted to shift the transfer sheet from the reference position F in the direction B by the amount corresponding to the change of the dimension of the transfer sheet which has been detected and stored in the MPU, more particularly, by the amount of one half of the contraction of the transfer sheet, when the dimensional change is the contraction. Then, by the instructions from the MPU, the spring clutch 49 is disengaged so that the lateral shifting movement of the upper roller 40*a* and the lower roller 40*b* is stopped. The upper roller 40*a* and the lower roller 40*b* continue rotating for a predetermined period of time so that the transfer sheet is advanced from the sheet conveying passage 23 to the registration roller couple 22 with its lateral position corrected. After the transfer sheet is conveyed, the electromagnetic clutch 56 is disengaged so as to stop rotations of the rollers 40*a* and 40*b*. After termination of the conveyance, the spring clutch 49 is engaged so as to rotate the cam member 47, thus moving the upper roller 40*a* and the lower roller 40*b* back in the direction B. This movement of the position correcting means 39 stops when the light blocking plate 52 and the photosensor 53 detect that it comes to the central home position. Thus, it is prepared for the next position correcting operation.

Next, the description will be made with respect to the correcting operation for compensating the dimensional change of the transfer sheet in the direction of the conveyance, which is produced in the image fixing step. The transfer sheet having received the toner image in the copying station passes by the detecting means 80, and its leading edge pivots the detecting lever 81. The detecting lever 81 is restored by the passage of the trailing edge of the transfer sheet. The rotation of the detecting lever 81 by the passage of the transfer sheet blocks the light to the photosensor 82. The length of the time period in which the light is blocked corresponds to the dimension of the transfer sheet in the direction of the sheet conveyance, and stored in the MPU. Next, the transfer sheet is subjected to the image fixing operation in the image fixing station 25, and is conveyed under the auxiliary flapper 30 for the purpose of receiving the image on the other face. At this time, the detecting arm 31 and the photosensor 32 are operated by the rotation of the auxiliary flapper 30, whereby similarly to the case of detecting means 80, the dimension of the transfer sheet after being subjected to the image fixing operation is detected and transmitted to the MPU. In the MPU, the data prior to the image fixing operation and that after the image fixing operation are compared, so that the dimensional change of the transfer sheet is detected. The MPU prepares itself for controlling the registration roller couple 22 functioning as the position correcting means for the conveying direction, by the amount corresponding to the dimensional change of the transfer sheet. When the transfer sheet is re-fed to the sheet conveying passage 23 and is introduced to the registration roller couple 22, the sensor S2 detects that the leading edge of the transfer sheet engages to the registration roller couple 22 to be prepared for the positional correction. The timing of the refeeding is shifted from that in the previous copying operation by the amount corresponding to the dimensional change, that is, the contraction for example, more particularly by the amount of delay of one-half of the time required for the contracting amount to be fed by the registration roller couple 22. In the case of the superimposing copy, the transfer sheet discharged from the first discharging roller couple 26 is not directed to under the auxiliary flapper 30 but is re-fed to the sheet conveying passage 23. To accomplish the same operation in this case, a sensor which is similar to the detecting device 80 is disposed at a proper position in the sheet conveying passage 23, so that the positional correction of the transfer sheet can be performed in the case of the superimposing copy in addition to the duplex copying operation.

Figure 8:
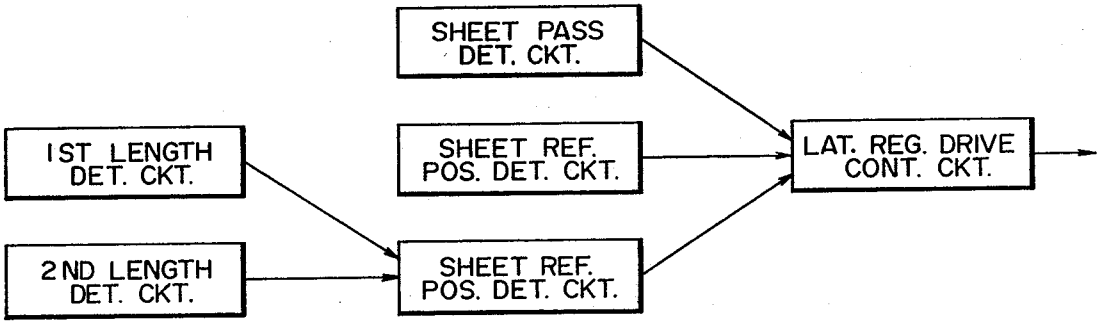
FIGS. 8 and 9 are block diagrams illustrating the control.
Figure 9:
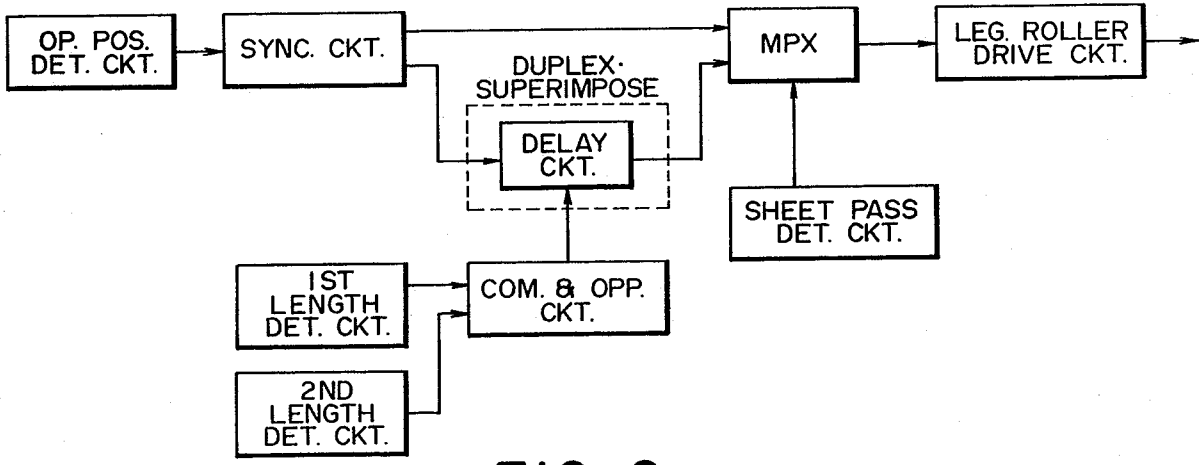

FIGS. 8 and 9 illustrate the control circuit for the embodiment of FIG. 7. The paper length detecting circuit ① includes the sensor 72, and the paper length detecting circuit ② includes the sensor 79. The sheet passage detecting circuit includes the sensor S1, and the sheet reference position detecting circuit includes the sensor 61. In this embodiment, the sensor 61 may be moved in the lateral direction in accordance with the change in the lateral dimension of the transfer sheet, and a lateral side of the transfer sheet may be aligned to the position of the sensor 61 after the movement.

Figure 4:
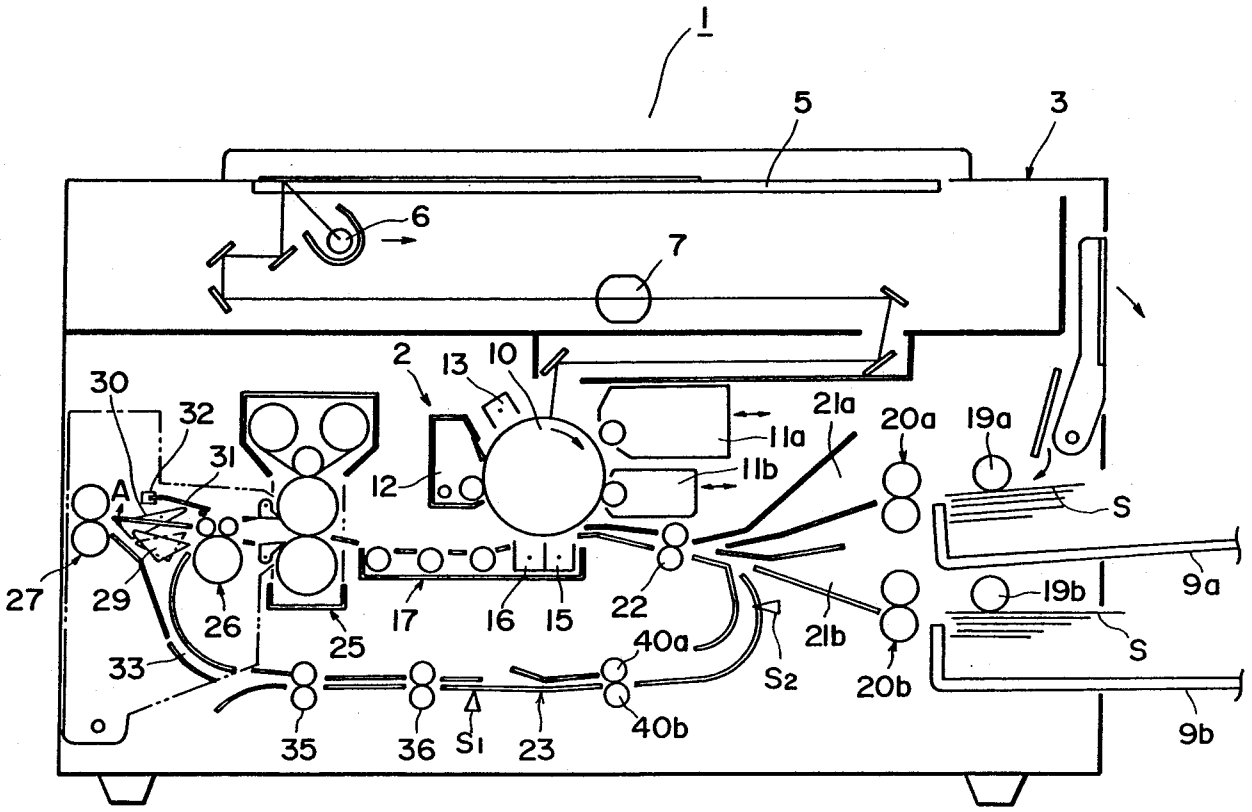
FIG. 4 is a sectional view of an image forming apparatus according to an embodiment of the present invention.
Figure 10:
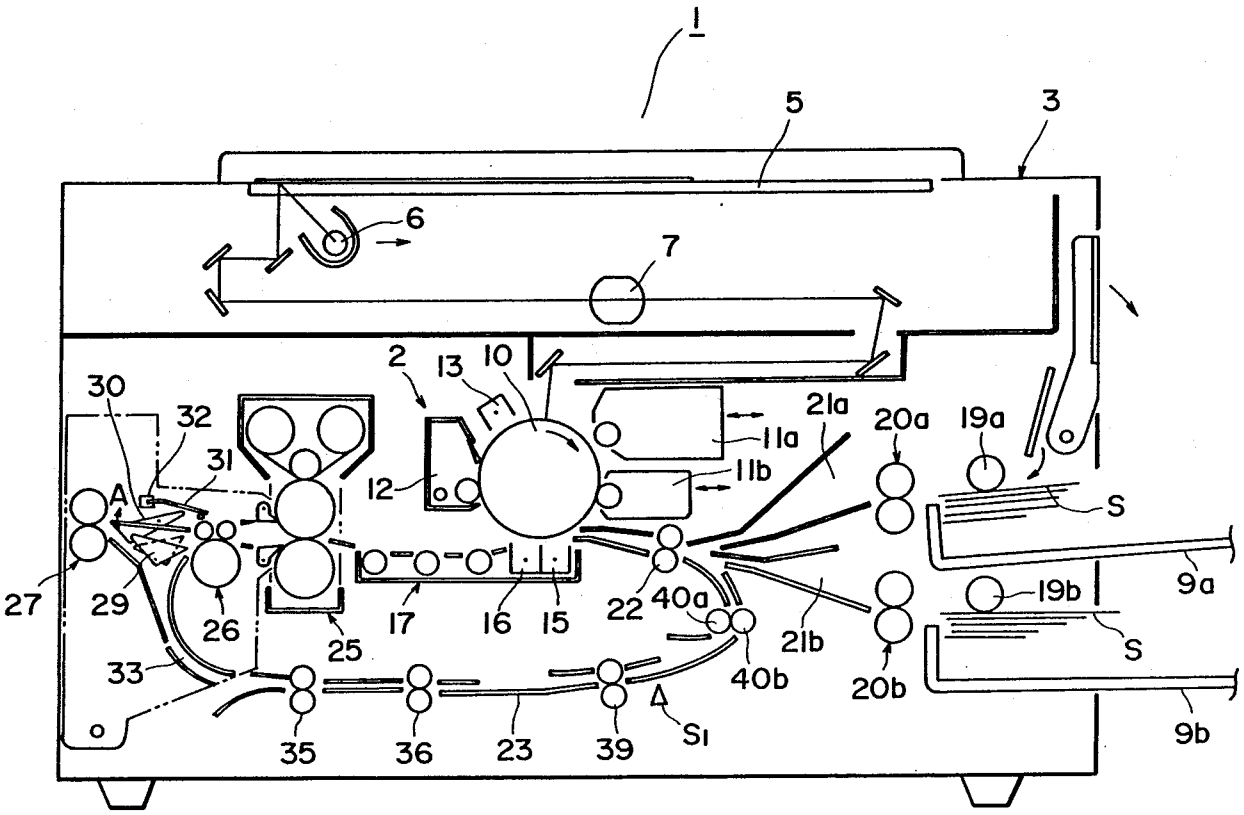
FIG. 10 is a sectional view of an image forming apparatus according to a further embodiment of the present invention.

Referring to FIG. 10, a further embodiment of the present invention will be described, wherein the rollers 40*a* and 40*b* of the position correcting means 39 also function as a registration roller. This embodiment, the rollers (lateral registration rollers) 40*a* and 40*b* are relatively very close to the registration roller 22 as compared with the case of FIG. 4 embodiment. Because of this, the conveying distance from the lateral registration rollers 40*a* and 40*b* to the photosensitive drum 10 is reduced, so that the variation of the time period is reduced or minimized from the start of the rotation of the lateral registration roller 40*a* and 40*b* to the transfer sheet reaching the photosensitive drum 10. In operation, the transfer sheet is introduced in the direction of an arrow A, and the sensor S1 detects the passage of the transfer sheet immediately before the lateral registration roller 40*a* and 40*b*. Then, the conveying roller couple 39 conveys the transfer sheet during a predetermined period of time on the basis of the timing at which the sensor S1 detects the passage of the transfer sheet. During this, the lateral registration rollers 40*a* and 40*b* do not rotate, so that a proper amount of loop of the transfer sheet is formed between the lateral registration roller couple 40*a* and 40*b* and the conveying roller 39 because the conveying roller 39 continues rotating and stops at a properly predetermined timing. The loop is formed in order to remove the inclined advancement of the sheet and to allow the transfer sheet to move in the lateral direction without difficulty by the lateral registration roller.

Here, the transfer sheet stops with the loop formed therein. Then, the operator places another original on the original carrying table for the purpose of the superimposing copy or the duplex copy, and depressed the copy button again. Then, the optical system starts moving for the optical scan. At a point of the time when the optical system comes to a predetermined point, a signal for starting the rotation of the lateral registration roller is produced. The timing of this is shifted in consideration of the change of the dimension of the transfer sheet in the direction of sheet conveyance in the manner described above. Then, the electromagnetic clutch 56 is engaged so as to permit the rotation of the input gear 57*a* to be transmitted to the gear 60 so that the lower roller 40*b* of the lateral registration roller starts rotating. The registration roller 22 functions only as a conveying roller in the case of the superimposing copy and the duplex copy. Therefore, it starts rotating simultaneously with the start of the lateral registration roller 40*b* and continues its rotation until the transfer sheet completes the passage therethrough.

Thereafter, the lateral registration rollers 40*a* and 40*b* grip sufficiently the transfer sheet. The spring clutch 49 is then engaged so that the rotation of the driving gear 50 is transmitted to the cam 47. The cam 47 pushes the block 46 supporting the upper and lower lateral registration rollers 40*a* and 40*b* in the direction of an arrow C, whereby the upper and lower lateral registration rollers 40*a* and 40*b* are laterally shifted in the direction of the arrow C through the block 46. The block 46 is provided with a roller 46*a* so that the rolling contact between the cam and the roller reduces the load in the direction of rotation. When an edge of the transfer sheet reaches a predetermined position, the sensor 61 fixedly mounted on the main frame is shaded by the on-coming sheet to produce a signal representing completion of the lateral registration and transmit the signal to the controller. Here, the sensor 61 is moved and placed at a position determined in accordance with the lateral dimensional change of the sheet in the manner described above. When the signal is transmitted to the controller, the controller disengages the spring clutch 49 so as to stop the lateral shifting of the roller, and continues the engaged state of the electromagnetic clutch 56 so that the sheet is left from the lateral registration rollers 40*a* and 40*b*.

The upper and lower lateral registration rollers 40*a* and 40*b* are provided with compression coil springs 45 at four positions, which are effective to urge the rollers in the direction of the arrow B. Therefore, when the cam 47 continues rotating until the limiting position in the direction of the arrow C is reached, the inclined surface of the cam 47 displaces in the direction of the arrow B. The compression coil springs 45 are effective to cause the rollers to follow the change of the inclined surface of the cam. When the roller 40*b* moves to the home position of the roller 46 (a predetermined position at which it is positioned until the sheet comes), the light blocking plate 52 mounted coaxially with the spring clutch 49 blocks the light. In response to the signal of the light blocking, the spring clutch 49 is deenergized so that the lateral movement of roller stops.

Figure 11:
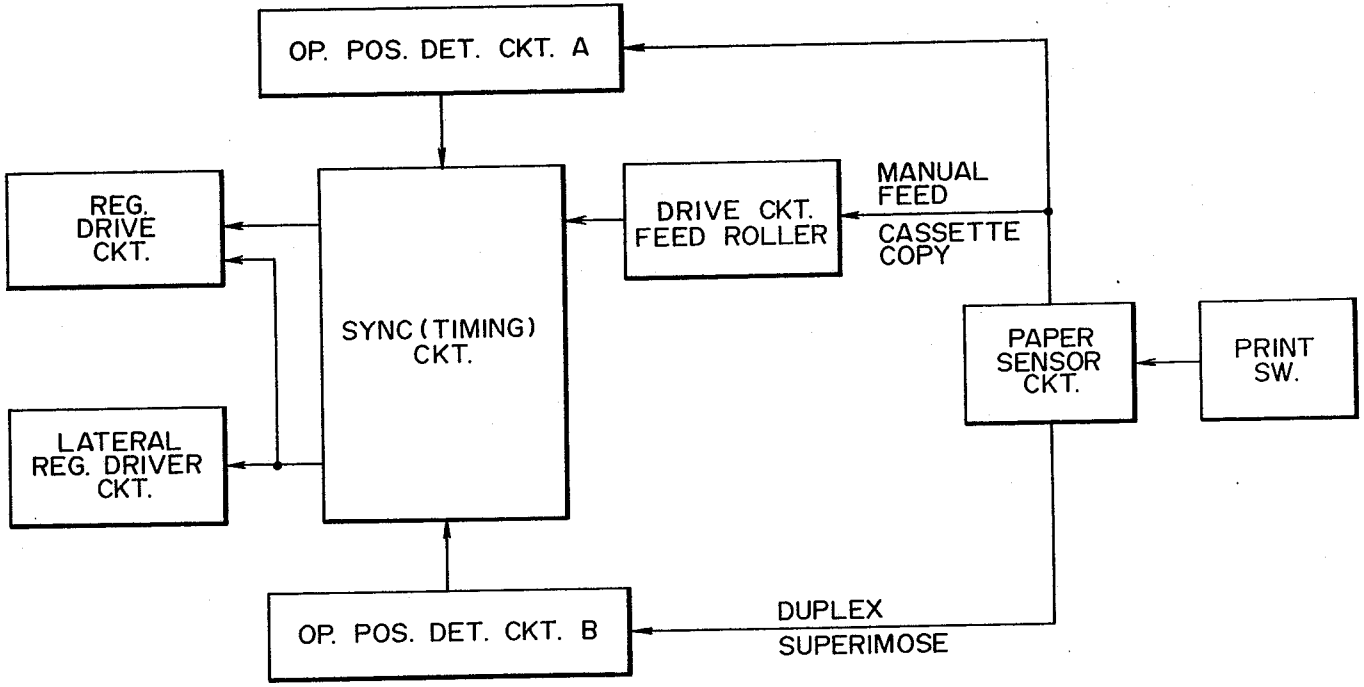
FIG. 11 is a block diagram illustrating the control.
Figure 12:
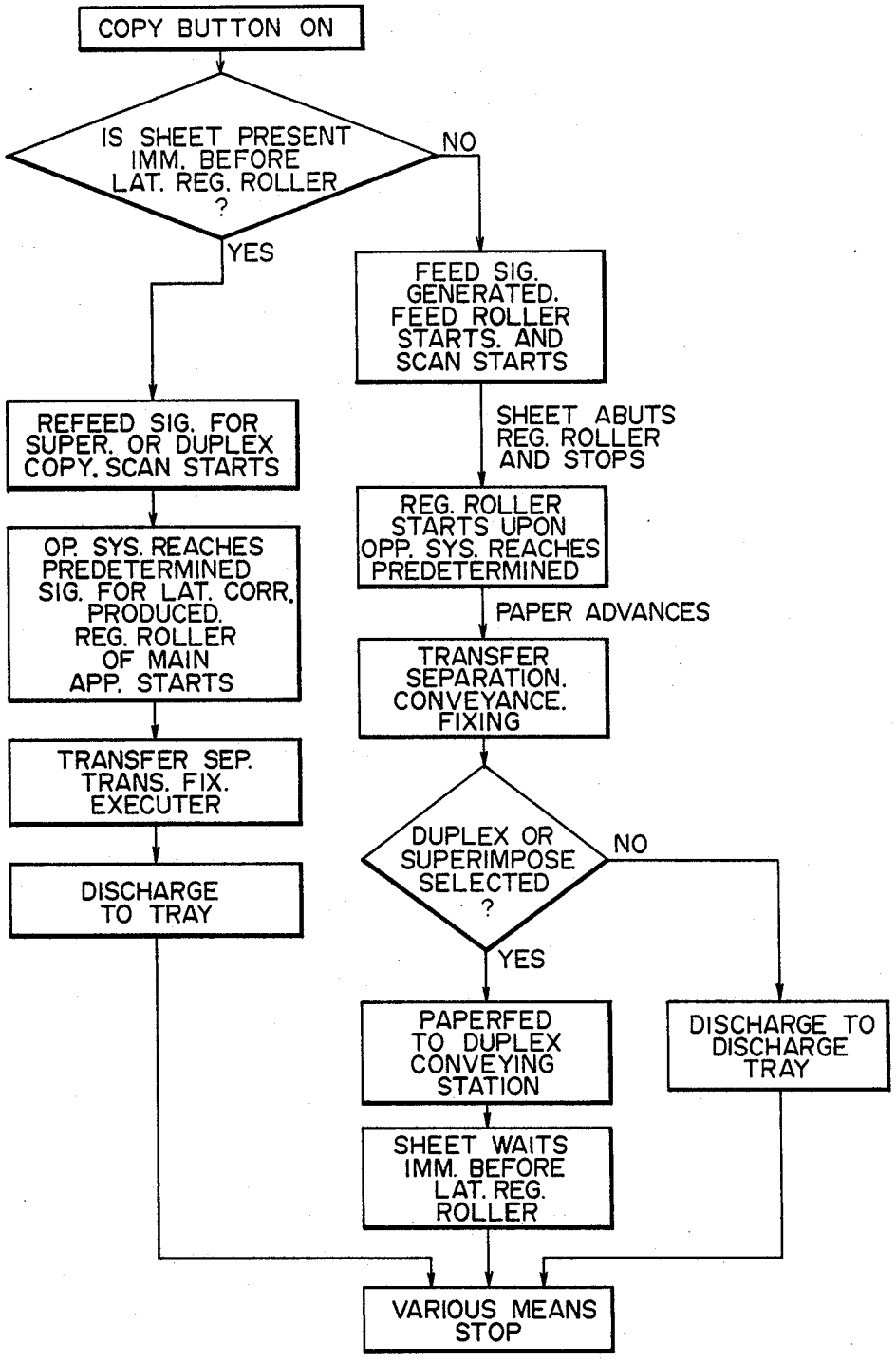
FIG. 12 is a flow chart explaining the control operation.

FIG. 11 is a block diagram illustrating the control of this embodiment. FIG. 12 is the flow chart illustrating the control. According to this embodiment, the lateral registration roller 40*b* also functions as the registration roller for the control of the leading edge of the transfer sheet re-fed to the photosensitive drum for the purpose of the superimposing copy and the duplex copy. In the case of the superimposing copy or the duplex copy operation, the registration roller 22 is operated simply as a conveying roller, so that the possible problem can be avoided which may be caused by the curling of the sheet conveyed to the registration roller 22.

Figure 13:
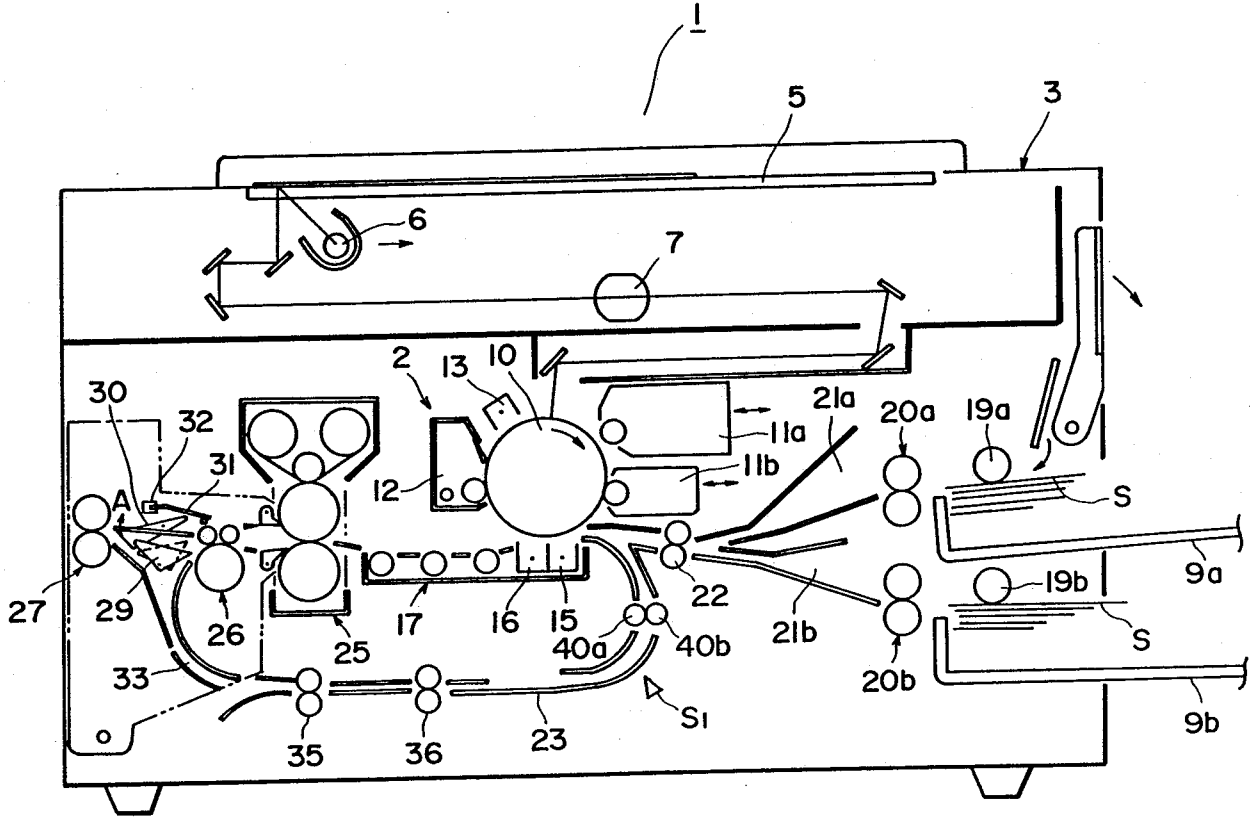
FIG. 13 is a sectional view of an image forming apparatus according to a further embodiment of the present invention.
Figure 14:
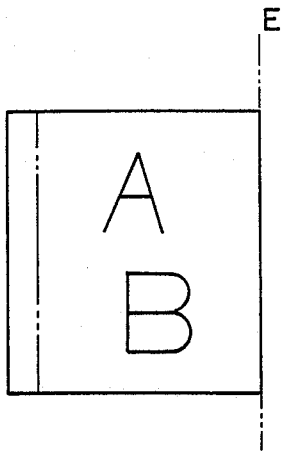
FIG. 14 is a plan view illustrating the lateral deviation in the conventional apparatus.
Figure 15:
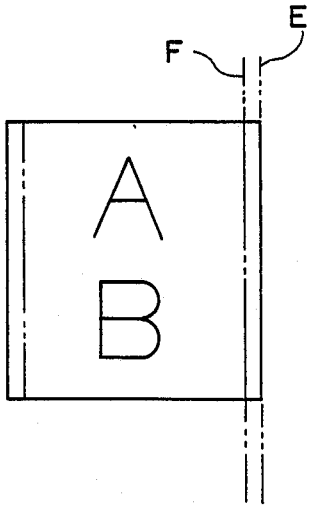
FIG. 15 is a plan view illustrating the resultant copy by the image forming apparatus according to the present invention.

Referring to FIG. 13, a further embodiment of the present invention will be described. This embodiment is similar to the previous embodiment but is different in that, in the superimposing or duplex copy, the transfer sheet which has been subjected to the lateral and leading edge registration correction operations by the lateral registration roller is directly conveyed to the transfer drum 10 without passing through the registration roller couple 22. The sheet which has been corrected in the position in the lateral and conveying directions is not necessarily transported through the registration roller couple 22 which functions only as a conveying roller couple in this case. Noting this, the sheet is directly transported to the photosensitive drum in this embodiment. This reduces the distance of conveyance from the lateral registration roller to the photosensitive drum, so that the variation of the time period required for the conveyance can be reduced, thus reducing the deviation of the image on the sheet which can result from the errors in the registration adjustment.

According to this embodiment, the lateral registration roller has also the function of the leading edge registration. By this, the problem which can not be solved by the registration roller in the main assembly can be solved, that is, the problem arising from the curled sheet entering the registration roller couple. The transfer sheet transported from the copying station for the purpose of the superimposing copy and the duplex copy is introduced into the nip of the lateral registration roller couple through the sheet conveying passage 23 which may be particularly designed so that the sheet can be easily introduced into the nip. Further, the lateral registration correction and the leading edge registration correction are both simultaneously effected, and then the transfer sheet is conveyed to the photosensitive drum. Thus, a correctly superimposed or duplexed copy can be provided. According to this embodiment, the correct lateral registration and the correct leading edge registration can be effected to the sheet material which has been curled because of the image processing operation to which it has been subjected.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image forming station for conveying a sheet material along a stationary lateral reference position and for forming an image on the sheet material;

refeeding means for refeeding to said image forming station the sheet material on which the image has been formed in said image forming station;

means, provided in said sheet refeeding means, for shifting the sheet material in the lateral direction from the stationary lateral reference position by a predetermined amount, wherein the amount of the shift is predetermined on the basis of a change in a lateral dimension of the sheet material resulting from an image forming operation in said image forming station.

2. An apparatus according to claim 1, wherein said shifting means includes a mechanism for shifting the sheet material in a thrust direction of said mechanism and means for detecting the sheet material shifted by said shifting means.

3. An apparatus according to claim 2, wherein said detecting means is disposed at a position deviated from said lateral reference position by the predetermined amount and is effective to detect a lateral end of the sheet material.

4. An apparatus according to claim 2, wherein said shifting mechanism includes conveying rollers movable in the thrust direction while gripping the sheet material.

5. An apparatus according to claim 3, wherein an amount of deviation corresponds to one half of the change in the lateral dimension of the sheet material.

6. An apparatus according to claim 2, wherein said detecting means is disposed at a position corresponding to said lateral reference position, and wherein said shifting mechanism laterally shifts the sheet material by the predetermined amount from a position detected by said detecting means.

7. An image forming apparatus, comprising:

an image forming station for conveying a sheet material along a stationary lateral reference position and for forming an image on the sheet material;

refeeding means for refeeding to said image forming station the sheet material on which the image has been formed in said image forming station;

means for detecting a change in a lateral dimension of the sheet material resulting from an image forming operation to the sheet material in said image forming station; and means, provided in said sheet refeeding means, for shifting the, sheet material in the lateral direction from the stationary lateral reference position by an amount based on detection by said detecting means.

8. An apparatus according to claim 7, wherein said shifting means includes a mechanism for shifting the sheet material in a thrust direction of said mechanism and means for detecting the sheet material shifted by said shifting means.

9. An apparatus according to claim 8, wherein said detecting means is disposed at a position deviated from said lateral reference position by the predetermined amount and is effective to detect a lateral end of the sheet material.

10. An image forming apparatus, comprising:

an image forming station for conveying a sheet material along a lateral reference position and for forming an image on the sheet material;

refeeding means for refeeding to said image forming station the sheet material on which the image has been formed in said image forming station;

means for detecting a change in a lateral dimension of the sheet material resulting from an image forming operation to the sheet material in said image forming station; and means, provided in said sheet refeeding means, for shifting the sheet material in the lateral direction from the lateral reference position by an amount based on detection by said detecting means, wherein said detecting means includes a first detecting element for detecting the lateral dimension of the sheet material prior to the image formation to the sheet material in said image forming station and a second detecting means for detecting the lateral dimension of the sheet material after the image forming operation thereto, and means for comparing detected dimension by said first detecting means and detected dimension by said second detecting means.

11. An apparatus according to claim 10, wherein said first and second detecting means each include a slit extending in a lateral direction of the sheet material.

12. An apparatus according to claim 8, wherein said detecting means is disposed at a position corresponding to said lateral reference position.

13. An apparatus according to claim 8, wherein said detecting means is movable from said lateral reference position in accordance with the change in the lateral dimension of the sheet material.

14. An image forming apparatus, comprising:

an image forming station for forming an image on a sheet material;

registration means for feeding the sheet material to said image forming station at timing in synchronism with operation of said image forming station;

refeeding means for refeeding to said image forming station the sheet material on which the image has been formed in said image forming station;

control means for controlling, when the sheet material is re-fed to said image forming station from said refeeding means, said registration means to delay or advance timing of feeding the sheet by said registration means by a predetermined period of time with respect to the synchronous timing at which the sheet material has been fed by said registration means before the refeeding of the sheet material, wherein an amount of the delay or advancement is predetermined on the basis of a change in a dimension of the sheet material in a conveying direction, resulting from an image forming operation in said image forming station.

15. An apparatus according to claim 14, further comprising detecting means, disposed upstream of the registration means in said refeeding means with respect to advancement of the sheet material, for detecting arrival of the sheet material thereto.

16. An image forming apparatus, comprising:

an image forming station for forming an image on a sheet material;

registration means for feeding the sheet material to said image forming station at timing in synchronism with operation of said image forming station;

refeeding means for refeeding to said image forming station the sheet material on which the image has been formed in said image forming station;

means for detecting a change in a dimension of the sheet material in a conveying direction, resulting from the image forming operation to the sheet material in said image forming station; and control means for controlling, when the sheet material is re-fed to said image forming station from said refeeding means, said registration means to delay or advance timing of feeding the sheet by said registration means in accordance with the change detected by said detecting means with respect to the synchronous timing at which the sheet material has been fed by said registration means before the refeeding of the sheet material.

17. An image forming apparatus, comprising:

an image forming station for forming an image on a sheet material;

registration means for feeding the sheet material to said image forming station at timing in synchronism with operation of said image forming station;

refeeding means for refeeding to said image forming station the sheet material on which the image has been formed in said image forming station;

means for detecting a change in a dimension of the sheet material in a conveying direction, resulting from the image forming operation to the sheet material in said image forming station; and control means for controlling, when the sheet material is re-fed to said image forming station from said refeeding means, said registration means to delay or advance timing of feeding the sheet by said registration means in accordance with the change detected by said detecting means with respect to the synchronous timing, wherein said detecting means includes a first detecting element for detecting the dimension of the sheet material prior to completion of the image formation, a second detecting element for detecting the dimension of the sheet material after completion of the image formation and means for comparing detection by said first detecting element and detection by said second detecting element.

18. An image forming apparatus, comprising:

an image forming station for forming an image on a sheet material;

first registration means operable at timing in synchronism with operation of said image forming station to convey the sheet material to said image forming station;

refeeding means for refeeding to said image forming station the sheet material on which the image has been formed in said image forming station;

second registration means, disposed in said refeeding means, for conveying the sheet material to said image forming station at registering timing;

control means for delaying or advancing the registering timing of said second registration means by a predetermined amount with respect to the synchronous timing by said first registration means, wherein the predetermined amount of the delay or advancement is predetermined on the basis of a change in a dimension of the sheet material in a conveying direction, resulting from an image forming operation in said image forming station.

19. An apparatus according to claim 18, wherein said first registration means is disposed between said image forming station and said second registration means, and wherein when the sheet material is conveyed by said second registration means, operation of said first registration means is disabled.

20. An apparatus according to claim 18, wherein said first registration means is disposed outside a sheet passage communicating said image forming station and said second registration means.

21. An apparatus according to claim 18 or 19, wherein said second registration means also functions as means for shifting the sheet material.

22. An image forming apparatus, comprising:

an image forming station for forming an image on a sheet material;

first registration means operable at timing in synchronism with operation of said image forming station to convey the sheet material to said image forming station;

refeeding means for refeeding to said image forming station the sheet material on which the image has been formed in said image forming station;

second registration means, disposed in said refeeding means, for conveying the sheet material to said image forming station at registering timing;

means for detecting a change in a dimension of the sheet material in a conveying direction resulting from the image forming operation to the sheet material in said image forming station; and control means for delaying or advancing a registration timing by said second registration means with respect to the synchronous timing by said first registration means in accordance with the change detected by said detecting means.

23. An image forming apparatus, comprising:

an image forming station for forming an image on a sheet;

a rotatable member for transferring the sheet in a first direction toward said image forming station;

supporting means for supporting said rotatable member for displacement in a second direction which traverses the first direction;

driving means for displacing said rotatable member in the second direction to correct deviation of the sheet in the second direction; and inlet guiding means for guiding the sheet to said rotatable member, said guiding means being displaceable in the second direction together with said rotatable member.

24. An apparatus according to claim 23, further comprising detecting means for detecting that the sheet reaches a reference position in the second direction.

25. An apparatus according to claim 23, further comprising transporting means for transporting the sheet along said inlet guiding means to said rotatable member while said rotatable member is not rotating, thus forming a loop in the sheet.

26. An apparatus according to claim 23, wherein inlet guiding means is engaged with a shaft of said rotatable member to be displaceable together with said rotatable member in the second direction.

27. An image forming apparatus comprising:

an image forming station for forming an image on a sheet; in a first a rotatable member for feeding the sheet direction toward said image forming station, said rotatable member being disposed in a passage of the sheet for refeeding the sheet to said image forming station;

supporting means for supporting said rotatable member for displacement in a second direction which traverses the first direction;

driving means for displacing said rotatable member in the second direction to correct deviation of the sheet in the second direction; and inlet guiding means for guiding the sheet to said rotatable member, said guiding means being displaceable in the second direction together with said rotatable member.

28. An apparatus according to claim 27, further comprising detecting means for detecting that the sheet reaches a reference position in the second direction.

29. An apparatus according to claim 27, wherein said refeeding passage conveys the sheet to said image forming station without inverting face orientation of the sheet to form a superimposed image said 30. An apparatus according to claim 27, wherein refeeding passage refeeds the sheet after inverting the face orientation of the sheet to provide a duplicate copy.

31. An apparatus according to claim 29, wherein said image forming station comprises an image bearing member, developing means for forming a visualized image on the image bearing member, transferring means for transferring the visualized image on the sheet and fixing means for fixing an image transferred onto the sheet, wherein said image forming station forms respective images on said image bearing member, corresponding to images to be formed on the respective sides on the sheet.

32. An apparatus according to claim 30, wherein said image forming station comprises an image bearing member, developing means for forming a visualized image on the image bearing member, transferring means for transferring the visualized image on the sheet and fixing means for fixing an image transferred onto the sheet, wherein said image forming station forms respective images on said image bearing member, corresponding to images to be formed on the respective sides on the sheet.

* * * * *

UNITED STATES PATENT AND TRADEMARK OFFICE

CERTIFICATE OF CORRECTION

PATENT NO. : 4,799,084 Sheet 1 of 3

DATED : January 17, 1989

INVENTOR(S) : MICHIRO KOIKE, ET AL.

It is certified that error appears in the above-identified patent and that said Letters Patent is hereby corrected as shown below:

Cover Page,

[56], "4,334,759 9/1982 Clausing ..... 355/3 SH" should be deleted.

Abstract, last line, "image" should read --image forming--.

Drawing,

Sheet 9, Fig. 11, "DUPLEX SUPERIMOSE" should read --DUPLEX SUPERIMPOSE--.

Column 1, line 20, "light source," should read --light source 6,--;

line 22, "there," should read --there--;

line 25, "device" should read --devices--.

Column 4, line 37, "FIG. 3" should read --FIG. 2--.

Column 5, line 16, "transported" should read --is transported--.

Column 6, line 7, "light" should read --right--.

UNITED STATES PATENT AND TRADEMARK OFFICE

CERTIFICATE OF CORRECTION

PATENT NO. : 4,799,084 Sheet 2 of 3

DATED : January 17, 1989

INVENTOR(S) : MICHIRO KOIKE, ET AL.

It is certified that error appears in the above-identified patent and that said Letters Patent is hereby corrected as shown below:

Column 7, line 4, "sensor S2" should read --sensor S2 (Fig. 4)--;

line 28, "cleaning" should read --conveying--.

Column 8, line 34, "46" should read --36--.

Column 9, line 31, "stored" should read --is stored--.

Column 10, line 47, "depressed" should read --depresses--.

Column 11, line 10, "on-coming" should read --oncoming--;

line 37, "of roller" should read --of the roller--.

Column 13, line 12, "the," should read --the--.

UNITED STATES PATENT AND TRADEMARK OFFICE

CERTIFICATE OF CORRECTION

PATENT NO. : 4,799,084 Sheet 3 of 3

DATED : January 17, 1989

INVENTOR(S) : MICHIRO KOIKE, ET AL.

It is certified that error appears in the above-identified patent and that said Letters Patent is hereby corrected as shown below:

Column 16, line 16, "inlet" should read --said inlet--;

line 22, "in a first" should be deleted;

line 23, "direction" should read --in a first direction--;

line 43, "image said" should read --image.--;

line 45, "refeeding" should read --said refeeding--.

Signed and Sealed this

Thirtieth Day of May, 1989

*Attest:*

DONALD J. QUIGG

*Attesting Officer*

*Commissioner of Patents and Trademarks*